US005207841A

United States Patent [19]

Shigeta et al.

[11] Patent Number: 5,207,841

[45] Date of Patent: May 4, 1993

[54] SOFT MAGNETIC POWDER AND MAGNETIC SHIELD COMPOSITION

[75] Inventors: Masao Shigeta, Narashino; Asako Kajita, Abiko; Ippo Hirai, Yachiyo, all of Japan

[73] Assignee: TDK Corporation, Tokyo, Japan

[21] Appl. No.: 681,061

[22] Filed: Apr. 5, 1991

[30] Foreign Application Priority Data

Apr. 12, 1990 [JP] Japan ..... 2-97241
May 1, 1990 [JP] Japan ..... 2-115583

[51] Int. Cl.[5] ..... C22C 38/06; C22C 38/18

[52] U.S. Cl. ..... 148/307; 148/308; 148/309; 252/62.55

[58] Field of Search ..... 148/307, 308, 309; 420/78, 103, 117; 252/62.54, 62.55

[56] References Cited

FOREIGN PATENT DOCUMENTS 55-138025 10/1980 Japan ..... 148/309
57-039124 3/1982 Japan ..... 148/309
57-079144 5/1982 Japan ..... 148/309
57-101652 6/1982 Japan ..... 148/307
58-59268 4/1983 Japan .
58-50495 11/1983 Japan .
59-201493 11/1984 Japan .
63-39966 8/1988 Japan .
1-223627 9/1989 Japan .
2-042798 2/1990 Japan ..... 148/309

*Primary Examiner*—George Wyszomierski
*Attorney, Agent, or Firm*—Oblon, Spivak, McClelland, Maier & Neustadt

[57] ABSTRACT

Soft magnetic powder comprising flat soft magnetic particles of an alloy having a composition defined and encompassed by polygon ABCDE in a Fe-Si-Cr ternary composition diagram of FIG. 1 or polygon JKLMN in a Fe-Si-Al ternary composition diagram of FIG. 4 is suitable for use in magnetic shields. The flat soft magnetic particles are prepared by furnishing alloy particles having a predetermined composition, flattening them, and heat treating the flat particles to develop a peak corresponding to plane index (002) in an X-ray diffraction diagram thereof.

12 Claims, 5 Drawing Sheets

SOFT MAGNETIC POWDER AND MAGNETIC SHIELD COMPOSITION

This invention relates to soft magnetic powder for use in magnetic shields, a method for preparing the same, and magnetic shield compositions containing the same.

BACKGROUND OF THE INVENTION

Magnetic shields are generally used for preventing influence of magnetic field-generating sources such as magnetized articles on other articles or electric circuits. A commonly used class of magnetic shields are sheet metals having high magnetic permeability and hence, high shielding properties although the sheet metals have only limited versatility in view of nature and cost.

Another class of magnetic shields are powder materials which can be advantageously applied in various ways. For example, magnetic powder is dispersed in organic binders to form coating compositions which are either directly applicable to sites to be shielded against magnetism or coated onto suitable flexible supports to form shielding plates.

A number of high magnetic permeability powders were proposed as magnetic shield materials.

Japanese Patent Application Kokai No. 201493/1984, for example, discloses a magnetic shield coating composition comprising flat particles obtained by finely dividing a soft magnetic amorphous alloy and a polymeric binder. Japanese Patent Application Kokai No. 59268/1983 discloses a magnetic shield coating composition comprising flat particles of a high magnetic permeability alloy dispersed in a polymeric binder. Japanese U.M. Publication No. 50495/1983 discloses to coat Sendust alloy flakes to form a magnetic shield film. Japanese Patent Publication No. 58631/1987 discloses a magnetic shield coating composition comprising flat, irregularly shaped particles dispersed in a polymeric binder, the particles being of Fe-Ni alloy, Fe-Ni-Co alloy, Fe-Si-Al alloy, and Fi-Ni-Mo alloy, which are commercially available as Permalloy, Molybdenum Permalloy, and Sendust alloy. Japanese Patent Publication No. 39966/1988 also discloses Permalloy magnetic shield films. Further, Japanese Patent Application Kokai No. 223627/1989 discloses magnetic shield protective films which are prepared by coating flat magnetic iron powder consisting of iron and either one of 0.5 to 20% by weight of Cr, 0.5 to 9% by weight (or 1 to 16.5 atom%) of Si, and 0.5 to 15% by weight of Al.

Flat alloy particles are often used in these magnetic shield films and compositions for the following reason. In coating such compositions, flat alloy particles are oriented such that their major surface is parallel to the coating surface. This means that the direction of flatness of particles coincides with the direction of magnetic shields on use, allowing the magnetic shields to take full advantage of the high magnetic permeability of the particles themselves due to the reduced diamagnetic field attributable to the flat geometry. Good magnetic shielding properties are provided since any loss of magnetic properties in a direction parallel to the coating surface by the influence of diamagnetic field is avoided.

Nevertheless, the conventional well-known alloy powders for magnetic shields have several problems.

Among Fe-Si-Al alloys, one having the composition of 9.6 wt % Si, 5.4 wt % Al, and the balance of Fe and exhibiting a highest maximum permeability μm is designated Sendust alloy. Sendust alloy suffers from inconvenience of handling because it is less corrosion resistant and in particular, becomes pyrophoric when divided into flat shape because of an increased specific surface area. It is also prone to rusting so that it detracts from magnetic properties and outer appearance. In addition, Sendust alloy has a saturation magnetostriction constant which is less than about $0.3\times10^{-6}$, but cannot be negative or lower than 0. When it is desired to use Sendust alloy as magnetic shielding material by flattening it into, flat particles, its magnetic properties can be deteriorated by stresses applied during flattening process and use, failing to meet the magnetic shield design requirement.

Permalloy type alloys including Permalloy and Molybdenum Permalloy are flattened through a rolling process rather than cleavage because of their crystal structure and thus require a longer time to flatten, leading to low productivity. The increased time of flattening process induces more stresses in particles, failing to provide high magnetic shielding properties. In addition, the Permalloy type alloys are about 5 to 10 times more expensive than the Sendust alloy.

Iron base amorphous alloys also give rise to problems as found with the Permalloy type alloys since they are flattened through rolling. Moreover, Permalloy type alloys and iron base amorphous alloys have increased magnetostriction and thus detract from magnetic properties not only through stress application during flattening, but also through stress application during milling with binder to form a coating composition. Another drawback of Permalloy type alloys is associated with their softness in that flat particles are liable to deform by stresses induced during milling to form a coating composition, also resulting in a loss of magnetic properties.

SUMMARY OF THE INVENTION

Therefore, an object of the present invention is to provide a novel and improved soft magnetic powder for magnetic shields which has high corrosion resistance and reduced magnetostriction. Another object of the present invention is to provide a novel and improved soft magnetic powder for magnetic shields which has reduced magnetostriction and stability against stresses. A further object is to provide a method for preparing such soft magnetic powder by flattening a source material in a rapid and efficient manner. A still further object is to provide a cost effective magnetic shield composition which contains such soft magnetic powder and exhibits enhanced magnetic shielding effect.

According to a first aspect of the present invention, there is provided a soft magnetic powder for use in magnetic shields. In one embodiment, the powder is in the form of flat soft magnetic particles of an alloy having a composition defined and encompassed by polygon ABCDE in a ternary composition diagram of FIG. 1 comprised of Fe, Si, and Cr wherein points A, B, C, D, and E have the following compositions as expressed in atomic percentage.

A: $Fe_{78}Si_{22}Cr_0$
B: $Fe_{70}Si_{30}Cr_0$
C: $Fe_{60}Si_{30}Cr_{10}$
D: $Fe_{63}Si_{18}Cr_{19}$
E: $Fe_{76}Si_{18}Cr_6$

The powder in another embodiment is in the form of flat soft magnetic particles of an alloy having a composition defined and encompassed by polygon JKLMN in a ternary composition diagram of FIG. 4 comprised of Fe, Si, and Al wherein points J, K, L, M, and N have the following compositions as expressed in atomic percentage.

J: $Fe_{83.8}Si_{9.2}Al_7$
K: $Fe_{84.7}Si_{9.3}Al_6$
L: $Fe_{85.6}Si_{10.4}Al_{4.0}$
M: $Fe_{84.9}Si_{11.1}Al_{4.0}$
N: $Fe_{83.2}Si_{9.8}Al_7$

In either of the embodiments, the flat soft magnetic particles show a peak corresponding to plane index (002) in an X-ray diffraction diagram thereof. More preferably, the flat soft magnetic particles meet $P(002)/P(022) \geqq 0.1\%$ wherein P(002) is a peak height corresponding to plane index (002) and P(022) is a peak height corresponding to plane index (022) in the X-ray diffraction diagram.

Preferably, the alloy has a saturation magnetostriction constant λs of zero or lower.

From a dimensional aspect, the flat soft magnetic particles have an average aspect ratio (average particle diameter divided by average thickness) of from 10 to 3,000. Further, the particles have a weight average particle diameter $D_{50}$ of 5 to 30 μm and an average thickness of up to 1 μm.

According to another aspect of the invention, there is provided a method for preparing soft magnetic powder for use in magnetic shields as defined above, comprising the steps of: furnishing particles of an alloy having a predetermined composition within the above-defined area in composition diagram, flattening the alloy particles, preferably in a media agitating mill, and heat treating the resulting flat soft magnetic particles, preferably at a temperature of from 100° to 600° C., thereby causing the particles to develop a peak corresponding to plane index (002) in an X-ray diffraction diagram.

Preferably, the soft magnetic alloy particles are heat treated prior to the flattening step.

Also provided by the invention is a magnetic shield composition comprising a soft magnetic powder as defined above and a binder.

The flat soft magnetic particles which constitute the soft magnetic powder for magnetic shields according to the invention are prepared by flattening particles of an alloy having the specific composition and heat treating the resulting flat soft magnetic particles. We have found that alloy particles having the specific composition are prone to cleavage, particularly when they have $DO_3$ type crystal structure, and thus quite suitable for the manufacture of flat soft magnetic particles intended herein.

With stresses applied, the alloy particles undergo cleavage into flat particles. Since the cleavage planes correspond to crystal faces and have regular directions, flattening is accompanied by a minimal loss of magnetic properties.

Further, because of the cleavage nature, the resulting flat soft magnetic particles have a high aspect ratio as given by average particle diameter divided by average thickness and a narrow distribution of aspect ratio and particle diameter and are best suited for the manufacture of magnetic shields.

As to the flattening process, the time required for flattening is substantially reduced as compared with Permalloy and other conventional alloys which undergo flattening through rolling. This leads to efficient production. Use of a media agitating mill ensures quicker flattening into flat soft magnetic particles with consistent properties. Since the starting alloy particles are generally prepared by rapidly quenching an alloy melt or finely dividing an alloy ingot, some particles might have a distorted crystal structure. A previous heat treatment on such particles can tailor the crystal structure to the regular $DO_3$ structure, allowing the flattening process to be completed in a shorter time.

The flat soft magnetic particles of the specific composition prepared in this way have high magnetic permeability and low coercive force, especially when they are of the $DO_3$ type crystal structure. They are thus best suited for the manufacture of magnetic shields.

The $DO_3$ type crystal structure is often lost as a result of stresses induced during flattening. A subsequent heat treatment on flattened particles allows the particles to resume the $DO_3$ type crystal structure.

In order that non-flattened alloy particles and flattened soft magnetic particles assume the $DO_3$ type crystal structure, both the previous and subsequent heat treatments may be done at temperatures as low as 100° to 600° C. Therefore, the particles can be heat treated without fire risk or sintering. It is to be understood that the presence of the $DO_3$ type crystal structure can be observed in an X-ray diffraction diagram as the appearance of a peak corresponding to plane index (002) characteristic of the $DO_3$ type crystal structure.

Further, the alloy particles of the above-defined composition can have a saturation magnetostriction constant λs of 0 or lower, avoiding any loss of magnetic permeability or any rise of coercive force by stresses applied during flattening and during milling with a binder to form a shield composition.

The alloy of the specific composition can have negative values (less than zero) of saturation magnetostriction constant, it is stable against stresses in that it does not experience a loss of magnetic permeability or a rise of coercive force which is otherwise incurred by stresses during flattening or during milling with binder to form a shielding composition. Magnetic shields do not detract from their magnetic properties upon application of stresses during use.

In the case of Fe-Si-Cr system, a further advantage of the flat soft magnetic particles of the specific composition is high corrosion resistance. Even when they are of an extensive flat shape having an increased specific surface area, they remain inflammable during heat treatment. They are free of any loss of magnetic properties or outer appearance due to rusting.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

Soft magnetic powder

The flat soft magnetic particles which constitute the soft magnetic powder for use in magnetic shields according to the present invention are, in one embodiment, of an alloy having a composition defined and encompassed by pentagon ABCDE in a ternary composition diagram of Fe, Si, and Cr. The ternary composition diagram is shown FIG. 1 where pentagon ABCDE is drawn by connecting points A, B, C, D, E, and A in this order, provided that points A, B, C, D, and E have the following compositions as expressed in atomic percentage.

A: $Fe_{78}Si_{22}Cr_0$
B: $Fe_{70}Si_{30}Cr_0$
C: $Fe_{60}Si_{30}Cr_{10}$
D: $Fe_{63}Si_{18}Cr_{19}$
E: $Fe_{76}Si_{18}Cr_6$

The reason of limitation is described. Outside line BC, magnetic shield properties are poor. Outside line CD, the alloy has a saturation magnetization of up to 5 kG and is unacceptable as magnetic shield material. Outside line DE, flattening requires a longer time. Outside line EA, the alloy is less corrosion resistant and can sometimes ignite during heat treatment.

For higher corrosion resistance, exclusion of line AB, that is, inclusion of Cr is recommended. The content of Cr is preferably at least 0.1 atom%.

Figure 1:
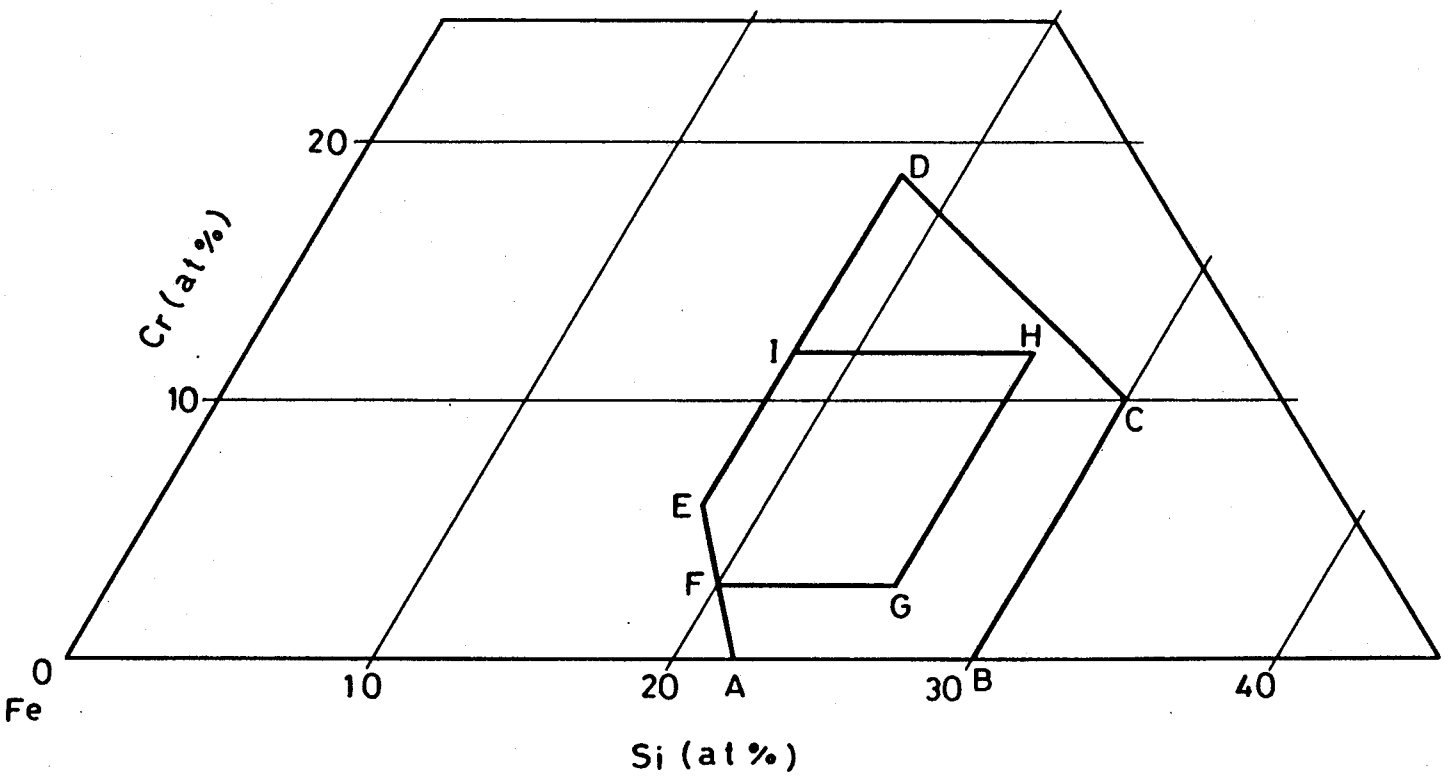
FIG. 1 is a ternary composition diagram of Fe, Si and Cr showing the alloy composition of flat soft magnetic particles as being defined and encompassed by polygon ABCDE.

In one preferred embodiment, the flat soft magnetic particles are of an alloy having a composition defined and encompassed by polygon FGHIE in the ternary composition diagram of FIG. 1 wherein points F, G, H, and I have the following compositions as expressed in atomic percentage.

F: $Fe_{77}Si_{20}Cr_3$
G: $Fe_{71}Si_{26}Cr_3$
H: $Fe_{62}Si_{26}Cr_{12}$
I: $Fe_{70}Si_{18}Cr_{12}$

Similarly, pentagon FGHIE is drawn in the diagram of FIG. 1 by connecting points F, G, H, I, E, and F in this order.

In another embodiment, the flat soft magnetic particles according to the present invention are of an alloy having a composition defined and encompassed by pentagon JKLMN in a ternary composition diagram of Fe, Si, and Al. The ternary composition diagram is shown FIG. 4 where pentagon JKLMN is drawn by connecting points J, K, L, M, N, and J in this order, provided that points J, K, L, M, and N have the following compositions as expressed in atomic percentage.

J: $Fe_{83.8}Si_{9.2}Al_7$
K: $Fe_{84.7}Si_{9.3}Al_6$
L: $Fe_{85.6}Si_{10.4}Al_{4.0}$
M: $Fe_{84.9}Si_{11.1}Al_{4.0}$
N: $Fe_{83.2}Si_{9.8}Al_7$

The reason of limitation is described. Outside lines JK and KL, stress application can incur a substantial loss of magnetic shield properties. Outside line LM, the flattening time is increased. Outside line MN, magnetic shield properties are poor. Outside line NJ, flattening requires a longer time.

Figure 4:
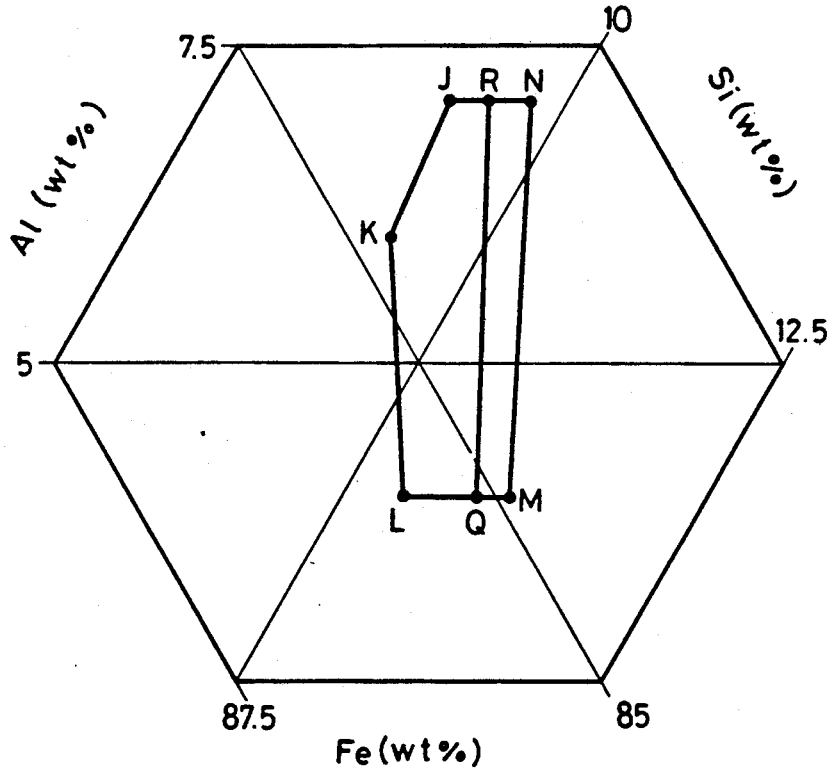
FIG. 4 is a ternary composition diagram of Fe, Si and Al showing the alloy composition of flat soft magnetic particles as being defined and encompassed by polygon JKLMN.

In one preferred embodiment, the flat soft magnetic particles are of an alloy having a composition defined and encompassed by polygon JKLQR in the ternary composition diagram of FIG. 4 wherein points Q and R have the following compositions as expressed in atomic percentage.

Q: $Fe_{85.1}Si_{10.9}Al_{4.0}$
R: $Fe_{83.5}Si_{9.5}Al_{7.0}$

Similarly, pentagon JKLQR is drawn in the diagram of FIG. 4 by connecting points J, K, L, Q, R, and J in this order.

In either of the Fe-Si-Cr and Fe-Si-Al systems, the flat soft magnetic particles may contain optional elements in addition to the essential elements. The additional elements are not particularly limited and may be selected from metal elements, typically transition metal elements and metalloid elements, for example, Ti, Zr, Nb, Ta, V, Mn, Mo, W, Co, Ni, Cu, Cr (for Fe-Si-Al system), Y, lanthanides, B, C and P. The content of additional elements is preferably 10 atom% or less, provided that the total of Fe, Si, and Cr or Fe, Si, and Al is 100 atom%.

The flat soft magnetic particles may contain incidental impurities such as N, 0 and S as long as they do not adversely affect magnetic properties.

Preferably, the flat soft magnetic particles show a peak corresponding to plane index (002) in an X-ray diffraction diagram thereof. This peak indicates the presence of the $DO_3$ type crystal structure.

More benefits attributable to the $DO_3$ type crystal structure are available when the flat soft magnetic particles meet $P(002)/P(022) \geqq 0.1\%$ wherein P(002) is a peak height corresponding to plane index (002) and P(022) is a peak height corresponding to plane index (022) in the X-ray diffraction diagram. It is to be noted that in an X-ray diffraction diagram of the Fe-Si-Cr system using an Fe target, the peak corresponding to plane index (002) appears at $2\theta = 39.5°$ and the peak corresponding to plane index (022) appears at $2\theta = 57.2°$ In an X-ray diffraction diagram of the Fe-Si-Al system using a Cu-target, the peak corresponding to plane index (002) appears at $2\theta = 31.28°$ and the peak corresponding to plane index (022) appears at $2\theta = 44.92°$.

The soft magnetic powder has a maximum magnetic permeability of 20 to 80, especially 25 to 60 and a coercive force Hc of 1 to 20 Oe, especially 1 to 14 Oe.

The alloy of which the flat soft magnetic particles are formed preferably has a negative saturation magnetostriction constant $\lambda s$ of less than zero, more preferably from $-10 \times 10^{-6}$ to less than 0, most preferably from $-3 \times 10.6^{-6}$ to $-0.01 \times 10^{-6}$.

Now, the preferred dimensions and shape of flat soft magnetic particles are described.

The flat soft magnetic particles have an (average) particle diameter and an (average) thickness. The average thickness should preferably be up to 1 μm, more preferably 0.01 to 1 μm. Particles with an average thickness of less than 0.01 μm are not only less dispersible in a binder in preparing a magnetic shield composition, but are also reduced in magnetic properties such as magnetic permeability. An average thickness of more than 1 μm is undesirable because it is difficult to thinly coat a magnetic shield composition to form a coating having flat soft magnetic particles uniformly dispersed therein.

In addition, the coating has a less number of flat soft magnetic particles distributed in a thickness direction of the coating and provides insufficient shielding properties. Better results are obtained with an average thickness of from 0.01 to 0.6 μm. It is understood that the average thickness is determined by means of a scanning electron microscope for analysis.

The flat soft magnetic particles preferably have an average aspect ratio of from 10 to 3,000, especially from 10 to 500. By the average aspect ratio used herein is meant the average diameter divided by the average thickness of flat particles. Particles with an aspect ratio of less than 10 would be greatly affected by a diamagnetic field and insufficient in magnetic properties such as permeability and shielding properties. Flat particles having an average thickness within the above-mentioned range, but an aspect ratio in excess of 3,000, which means that their average diameter is too large, are susceptible to rupture during milling with a binder, resulting in a loss of magnetic properties.

The average particle diameter is a weight mean particle diameter $D_{50}$. It is the diameter of flat soft magnetic particles at which the integrated value reaches 50% of the weight of the overall soft magnetic powder when the soft magnetic powder is divided into fractions of flat particles and the weight of flat particle fractions having successively increasing diameters is integrated from the smallest diameter fraction. The particle diameter is a measurement by a light scattering particle counter. More particularly, light scattering particle size analysis is carried out by causing particles to circulate, directing light from a light source such as a laser or halogen lamp, and measuring Fraunhofer diffraction or the scattering angle of Mie scattering, thereby determining the distribution of particle size. The detail of particle size measurement is described in "Funtai To Kogyo" (Powder and Industry), Vol. 19, No. 7 (1987). $D_{50}$ can be determined from the particle size distribution obtained from the particle counter.

The flat soft magnetic particles used herein preferably have a $D_{50}$ of 5 to 30 μm.

Desirably, the flat soft magnetic particles have a larger elongation of at least 1.2 when the magnetic shield is required to be directional. Provided that a flat particle has a length or major diameter a and a breadth or minor diameter b along a major surface configuration, the elongation used herein is a ratio of length to breadth, a/b. If a magnetic field source to be shielded is directional, a magnetic coating composition is cured while an orienting magnetic field is applied in the same direction. Then the permeability in the direction is improved, providing an increased magnetic shield effect in the desired direction. Better results are obtained with an elongation a/b in the range of from 1.2 to 5. Such an elongation is readily achievable with the use of a media agitating mill. The length and breadth of particles can be measured by a transmission electron microscope for analysis.

Preparation method

It is now described how to prepare the soft magnetic powder according to the invention. Briefly stated, the method involves furnishing alloy particles, optionally heat treating them, flattening them, and then heat treating the flat particles.

First, particles of an alloy having a composition within pentagon ABCDE in the diagram of FIG. 1 or pentagon JKLMN in the diagram of FIG. 4 are flattened into flat soft magnetic particles. The starting alloy particles may be prepared by conventional methods, for example, by rapidly quenching an alloy melt or finely dividing an alloy ingot.

The rapid quenching of an alloy melt is not particularly limited although a water atomizing method is recommended because it can yield alloy particles of desired size without grinding. The water atomizing method involves injecting water under high pressure to an alloy melt, thereby atomizing and solidifying the alloy, followed by cooling in water. The detail of the water atomizing method is described in U.S. application Ser. No. 528,827 filed May 25, 1990 and Japanese Patent Application No. 12267/1989.

The method for producing alloy particles is not limited to the water atomizing method. It is also possible to produce alloy particles by injecting a melt against a chill roll to produce ribbons, flakes or particles. Conventional single and double chill roll methods and atomizing methods may be used. The rapidly quenched alloy may be finely divided into alloy particles of desired size if necessary.

Where alloy particles are prepared by comminuting an alloy ingot, it is desirable to subject the ingot to solid solution treatment prior to comminution.

The alloy particles have an average particle diameter which may be determined depending on the desired diameter and aspect ratio of the flat soft magnetic particles although a weight average particle diameter $D_{50}$ of 5 to 30 μm, more preferably from 7 to 20 μm is preferred.

Often, the alloy particles are previously heat treated in order to tailor the crystal structure, typically at a temperature of 100° to 600° C. for 10 minutes to 10 hours.

Any desired means may be employed for the purpose of flattening alloy particles. Flattening means effective for inducing cleavage is preferred because alloy particle flattening proceeds mainly by way of cleavage. Such effective flattening means include a media agitating mill and a tumbling ball mill, with the media agitating mill being preferred. The media agitating mill is a class of agitators including pin mills, bead mills, and agitator ball mills, with examples being shown in Japanese Patent Application Kokai No. 259739/1986 and U.S. Ser. No. 528,827.

A next step is to heat treat the flat particles of the desired shape and dimensions resulting from the media agitating mill. The heat treatment causes the material to create or resume the $DO_3$ type crystal structure. Typically, the flattened particles are heat treated at a temperature of 100° to 600° C. for 10 minutes to 10 hours. Lower temperatures or shorter times do not achieve the purpose of heat treatment whereas the material can be ignited or sintered at higher temperatures. More preferably, the particles are heat treated at 300° to 500° C. for 30 minutes to 2 hours, typically in vacuum or in an atmosphere of inert gas such as nitrogen, hydrogen and argon. It is also acceptable to carry out heat treatment in a magnetic field.

Magnetic shield composition

The thus obtained soft magnetic powder is blended with a binder to form a magnetic shield composition in which flat particles are dispersed in the binder.

The magnetic shield composition preferably has a maximum permeability μm of at least 50, more preferably at least 100, especially 150 to 400, most preferably 180 to 350 in a DC magnetic field and a coercive force Hc of 2 to 20 Oe, more preferably 2 to 15 Oe as calculated on the assumption that the composition consists of 100% of the powder. These magnetic properties offer a satisfactory U magnetic shield effect.

The soft magnetic powder preferably occupies 60 to 95% by weight of the magnetic shield composition. If the packing is less than 60% by weight, the magnetic shield effect would be drastically reduced. If the packing is more than 95% by weight, the magnetic shield composition would be reduced in strength because the binder is too short to firmly bind soft magnetic particles together. Better magnetic shield effect and higher strength are obtained with a packing of 70 to 90% by weight.

The binder used herein is not particularly limited. It may be selected from conventional well-known binders including thermoplastic resins, thermosetting resins, and radiation curable resins.

The magnetic shield composition may contain a curing agent, dispersant, stabilizer, coupler or any other desired additives in addition to the soft magnetic powder and the binder.

The magnetic shield composition is generally used by molding it into a desired shape, or blending it with a suitable solvent to form a coating composition and applying it as a coating, and then heat curing the shape or coating, if necessary. Curing is generally carried out in an oven at a temperature of 50° to 80° C. for about 6 to about 100 hours although curing conditions depend on a particular type of binder.

When it is desired to shape the magnetic shield composition into a film or thin band which is suitable as a magnetic shield, the film or thin band preferably has a thickness of 5 to 200 μm. Since the magnetic shield composition of the invention has magnetic properties as previously defined, films as thin as 5 μm can have a magnetic shielding effect. For shielding against a magnetic field having an intensity at which the shield composition is not magnetically saturated, the magnetic shielding effect is increased no longer by increasing the thickness of a film beyond 200 μm. The maximum thickness of 200 μm is also determined for economy.

When the magnetic shield composition is molded into a desired shape or coated, a directional magnetic shield can be produced by applying an orienting magnetic field or effecting mechanical orientation. Particularly when the magnetic shield composition is formed into a plate or film having a thickness within the above-defined range, the plate or film shows a high magnetic shielding effect against a magnetic field parallel to the major surface thereof.

When used in the magnetic shield composition, the soft magnetic powder may be formed with a conductive coating of Cu, Ni or a similar metal.

EXAMPLE

Examples of the present invention are given below by way of illustration and not by way of limitation.

Examples 1-3 relate to the Fe-Si-Cr system.

EXAMPLE 1

Flat soft magnetic particles of different compositions were prepared to show the effectiveness of the invention.

Alloy particles were prepared by the water atomizing method, flattened by means of a media agitating mill, and then heat treated, obtaining a soft magnetic powder consisting of flat soft magnetic particles.

Table 1 shows the composition of flat soft magnetic particles and the holding temperature and time during the heat treatment.

Flattening in the medium agitating mill was conducted until the weight average particle diameter $D_{50}$ of flat soft magnetic particles reached 15 μm. The time taken for flattening was measured. The results are shown in Table 1.

The average thickness was measured by a scanning electron microscope for analysis and $D_{50}$ measured by means of a light scattering particle counter.

After the heat treatment, the flat soft magnetic particles were subject to X-ray diffraction analysis using an Fe target. From the X-ray diffraction diagram, the peak heights P(002) and P(022) at plane indexes (002) and (022) were determined to calculate P(002)/P(022).

The results of X-ray diffraction analysis are also shown in Table 1.

The alloy of each composition was measured for saturation magnetostriction constant λs, with the results shown in Table 1.

To examine corrosion resistance, these soft magnetic powders were dipped in 5% NaCl at 20° C. for 48 hours. Corrosion resistance was evaluated according to the following criterion.

○: outer appearance unchanged

Δ: slight color change

X: rust over the entire surface

A magnetic shield composition was prepared by mixing each soft magnetic powder with the following binder, curing agent and solvent.

| | Parts by weight |
|---|---|
| Binder | |
| Vinyl chloride-vinyl acetate copolymer (Eslek A, Sekisui Chemical K.K.) | 100 |
| Polyurethane (Nippolan 2304, Nihon Polyurethane K.K.), calculated as solids | 100 |
| Curing agent | |
| Polyisocyanate (Colonate HL, Nihon Polyurethane K.K.) | 10 |
| Solvent | |
| Methyl ethyl ketone | 850 |

The magnetic shield composition contained 80% by weight of the soft magnetic powder.

The magnetic shield composition was applied to a length of polyethylene terephthalate film of 75 μm thick to form a coating of 25 μm thick. The coated film was taken up in a roll form, which was heated at 60° C. for 60 minutes to cure the binder. The coated film was cut into sections which were used as shield plates. Table 1 reports a coercive force (Hc) calculated on a 100% powder basis as one representative magnetic property of the shield plate.

The shield plate was measured for shielding ratio as follows. The shielding plate was placed on a magnet to determine a leakage magnetic flux $\phi$ at a position spaced 0.5 cm from the plate. The shielding ratio ($\phi/\phi 0$) was determined by dividing the leakage magnetic flux $\phi$ by the magnetic flux $\phi 0$ determined without the shielding plate. The shielding ratio is calculated based on a shielding ratio of 100 for sample No. 1. Samples having a shielding value of 150 or lower are acceptable for magnetic shielding although lower shielding ratios are preferred.

For comparison purposes, soft magnetic powders were prepared by flattening particles of Sendust alloy, Permalloy, Molybdenum Permalloy and Fe base amorphous alloy under the same conditions as in Example 1. They were examined and evaluated by the same tests as above. The results are also shown in Table 1.

TABLE 2-continued

| Sample No. | Heat treatment °C./min. | P(002)/P(022) % | Hc Oe | Shielding ratio | Remarks |
|---|---|---|---|---|---|
| 26 | 650/60 | unmeasurable | 50 | 700 | burnt |

TABLE 1

| Sample No. | Composition | Heat Treatment (°C./min.) | P(002)/P(022) (%) | λs ($10^{-6}$) | Flattening Time (hour) | Corrosion resistance | Hc (Oe) | Shield ratio** | Remarks |
|---|---|---|---|---|---|---|---|---|---|
| 1 | $Si_{20}Cr_8$bal.Fe (at %) | 450 × 60 | 3.5 | −5 | 5 | ○ | 7 | 100 | |
| 2 | $Si_{20}Cr_5$bal.Fe (at %) | 450 × 60 | 3.2 | −6 | 5 | ○ | 8 | 105 | |
| 3 | $Si_{25}Cr_5$bal.Fe (at %) | 450 × 60 | 3.6 | −8 | 4 | ○ | 8 | 100 | |
| 4 | $Si_{30}Cr_5$bal.Fe (at %) | 450 × 60 | 3.0 | −4 | 5 | ○ | 10 | 110 | |
| 5 | $Si_{25}Cr_5Al_3$bal.Fe (at %) | 450 × 60 | 3.4 | −5 | 4 | ○ | 10 | 110 | |
| 6 | $Si_{25}Cr_5Nb_3$bal.Fe (at %) | 450 × 60 | 2.8 | −2 | 4 | ○ | 9 | 95 | |
| 7 | $Si_{25}Cr_5Mn_3$bal.Fe (at %) | 450 × 60 | 2.8 | −4 | 4 | ○ | 10 | 110 | |
| 8* | $Si_{35}Cr_5$bal.Fe (at %) | 450 × 60 | 0.1 | −15 | 7 | ○ | 19 | 250 | |
| 9* | $Si_{25}Cr_{20}$bal.Fe (at %) | 450 × 60 | 2.0 | −10 | 4 | ○ | 15 | 210 | |
| 10* | $Si_{15}Cr_{10}$bal.Fe (at %) | 450 × 60 | 0.5 | +3 | 8 | ○ | 20 | 300 | |
| 11* | $Si_{9.6}Al_{5.4}$bal.Fe (wt %) | NO | (002) NONE | ~0 | 5 | X | 15 | 140 | Sendust |
| 12* | $Ni_{50}$bal.Fe (wt. %) | NO | (002) NONE | +20 | 16 | X | 20 | 250 | Permalloy |
| 13* | $Ni_{80}Mo_5$bal.Fe (wt %) | NO | (002) NONE | ~0 | 16 | Δ | 15 | 180 | Molybdenum Permalloy |
| 14* | $Cr_4Nb_3Si_{18}B_6$bal.Fe (at %) | 450 × 60 | (002) NONE | +15 | 12 | ○ | 4 | 120 | Amorphous alloy |

*comparison

**relative value based on No. 3 = 100

The effectiveness of the invention is evident from Table 1.

More particularly, sample Nos. 1–7 within the scope of the invention show a shorter flattening time, high corrosion resistance, and a negative value of saturation magnetostriction constant λs. They also satisfy the low coercive force requirement as magnetic shields and provide high shielding ratios when formed into magnetic shield plates.

Sample Nos. 8–10 outside the scope of the invention show poor magnetic shield properties and sample No. 10 requires a longer time to flatten.

Sample No. 11 or Sendust alloy is less corrosion resistant. Sample Nos. 12–14 require at least twice longer time to flatten than the present samples and are low in productivity. Sample No. 12 or Permalloy shows low corrosion resistance, high magnetostriction, and poor shielding properties. Sample No. 13 or Molybdenum Permalloy is unacceptable in corrosion resistance and shielding properties. Sample No. 14 or Fe base amorphous alloy has high magnetostriction so that the desired shielding effect is lost when stresses are applied to shield members.

EXAMPLE 2

The properties of sample No. 3 in Table 1 were examined while the heat treating conditions were varied. The test conditions are the same as in Example 1.

The results are shown in Table 2.

Figure 2:
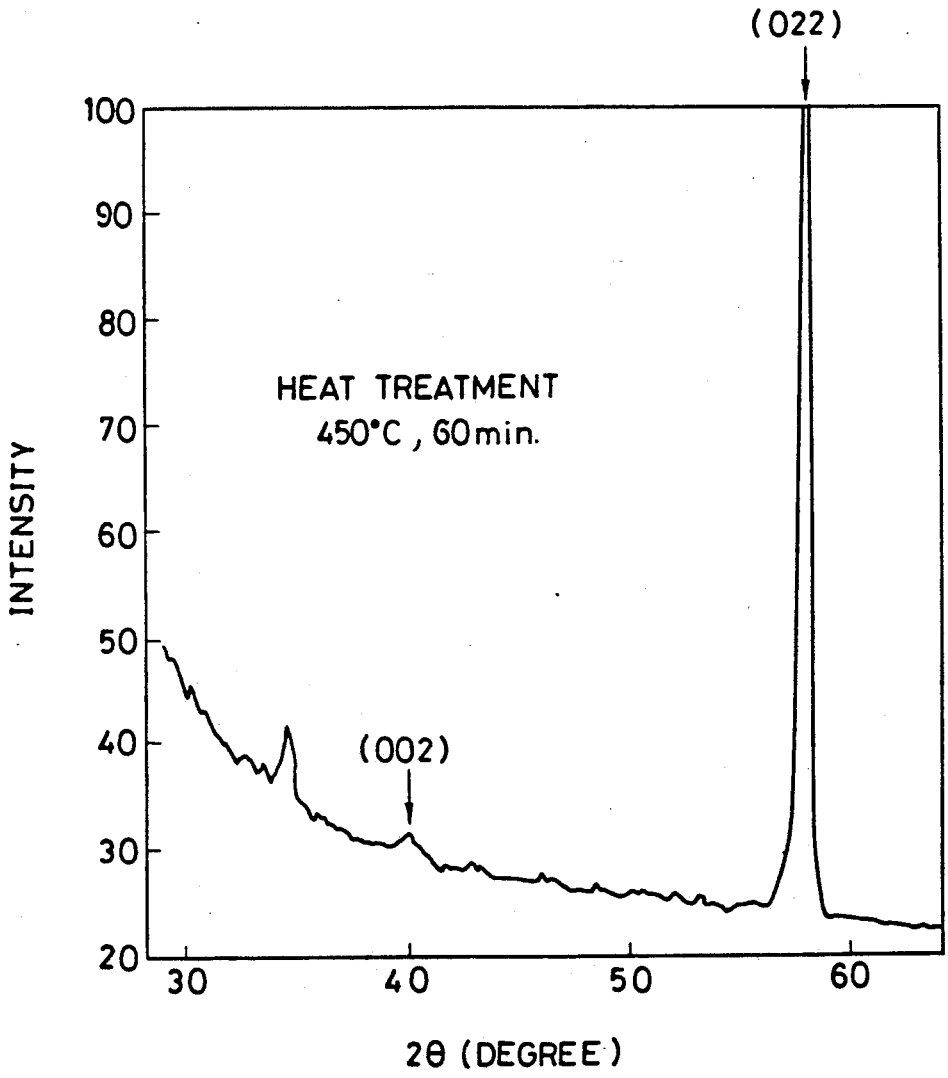
FIG. 2 is an X-ray diffraction diagram of flat soft magnetic particles of Fe-Si-Cr system which have been heat treated at 450° C. for 60 minutes (sample No. 24).
Figure 3:
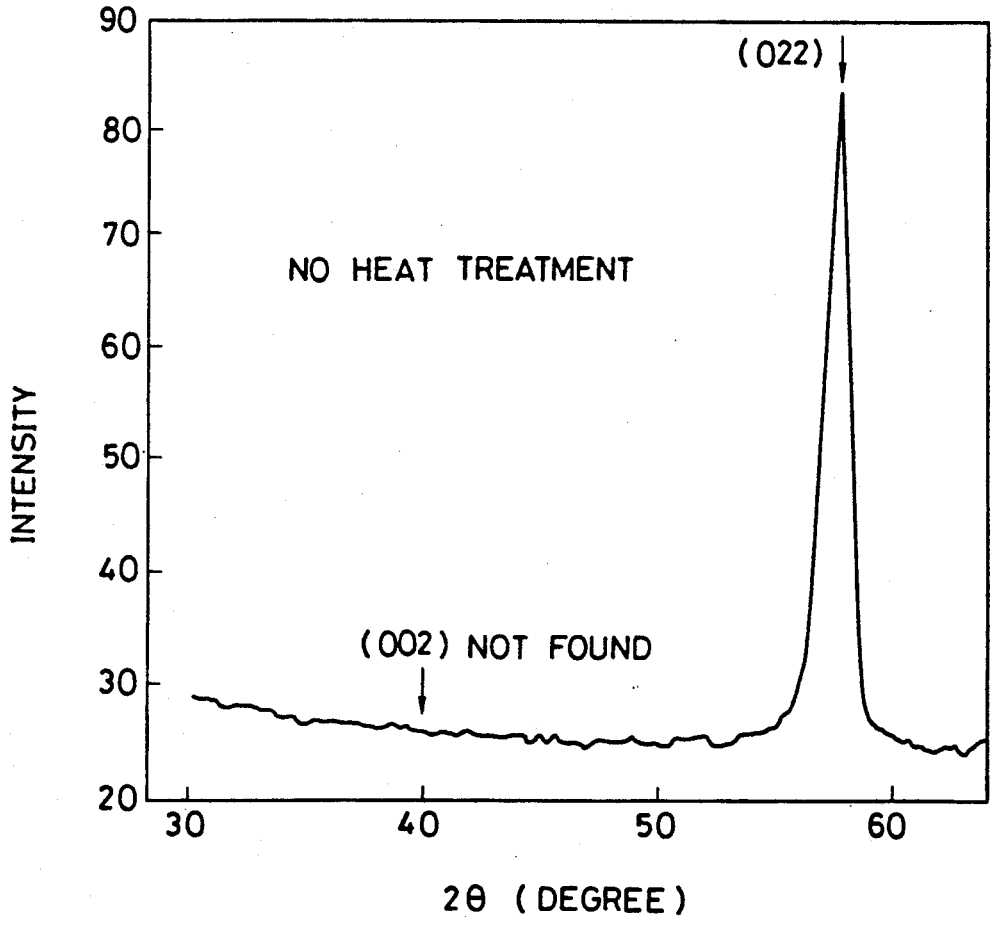
FIG. 3 is an X-ray diffraction diagram of the same flat soft magnetic particles prior to heat treatment (sample No. 21).

Sample Nos. 24 and 21 were analyzed by X-ray diffraction using an Fe target. X-ray diffraction diagrams are shown in FIGS. 2 and 3.

TABLE 2

| Sample No. | Heat treatment °C./min. | P(002)/P(022) % | Hc Oe | Shielding ratio | Remarks |
|---|---|---|---|---|---|
| 21 | no | (002) none | 22 | 350 | |
| 22 | 250/60 | 1.5 | 13 | 180 | |
| 23 | 350/60 | 1.8 | 12 | 130 | |
| 24 | 450/60 | 3.6 | 8 | 100 | = No. 3 |
| 25 | 550/60 | 4.1 | 7 | 100 | |

EXAMPLE 3

Alloy particles of the compositions shown in Table 1 were heat treated at 450° C. for one hour before flattening under the same conditions as in Example 1. The time taken for flattening was reduced by 10% or more.

Examples 4–6 relate to the Fe-Si-Al system.

EXAMPLE 4

Flat soft magnetic particles of different compositions were prepared to show the effectiveness of the invention.

Alloy particles were prepared by the water atomizing method, flattened by means of a media agitating mill, and then heat treated, obtaining a soft magnetic powder consisting of flat soft magnetic particles.

Table 3 shows the composition of flat soft magnetic particles and the holding temperature and time during the heat treatment.

Flattening in the medium agitating mill was conducted until the weight average particle diameter $D_{50}$ of flat soft magnetic particles reached 15 μm. The time taken for flattening was measured. The results are shown in Table 3.

The average thickness was measured by a scanning electron microscope for analysis and $D_{50}$ measured by means of a light scattering particle counter.

After the heat treatment, the flat soft magnetic particles were subject to X-ray diffraction analysis using a Cu target. From the X-ray diffraction diagram, the peak heights P(002) and P(022) at plane indexes (002) and (022) were determined to calculate P(002)/P(022).

The results of X-ray diffraction analysis are also shown in Table 3.

The alloy of each composition was measured for saturation magnetostriction constant λs. An alloy sample of 5×5×20 mm was heat treated as in Table 3 and measured by the three terminal capacity method, with the results shown in Table 3.

A magnetic shield composition was prepared by mixing each soft magnetic powder with the following binder, curing agent and solvent.

| | Parts by weight |
|---|---|
| Binder | |
| Vinyl chloride-vinyl acetate copolymer (Eslek A, Sekisui Chemical K.K.) | 100 |
| Polyurethane (Nippolan 2304, Nihon Polyurethane K.K.), calculated as solids | 100 |
| Curing agent | |
| Polyisocyanate (Colonate HL, Nihon Polyurethane K.K.) | 10 |
| Solvent | |
| Methyl ethyl ketone | 850 |

The magnetic shield composition contained 80% by weight of the soft magnetic powder.

The magnetic shield composition was applied to a length of PET film of 75 μm thick to form a coating of 25 μm thick. The coated film was taken up in a roll form, which was heated at 60° C. for 60 minutes to cure the binder. The coated film was cut into sections which were used as shield plates. Table 1 reports a coercive force (Hc) calculated on a 100% powder basis as one representative magnetic property of the shield plate.

The shield plate was measured for shielding ratio as follows. The shielding plate was placed on a magnet to determine a leakage magnetic flux $\phi$ at a position spaced 0.5 cm from the plate. The shielding ratio ($\phi/\phi 0$) was determined by dividing the leakage magnetic flux $\phi$ by the magnetic flux $\phi 0$ determined without the shielding plate. The shielding ratio is calculated based on a shielding ratio of 100 for sample No. 201. It is to be understood that samples having a shielding value of 150 or lower are acceptable for magnetic shielding purposes although lower shielding ratios are preferred.

To examine the influence of stress application on magnetic shield properties, a certain load was applied to a magnetic shield sample to measure a change in magnetic shield properties. The results are shown in Table 3.

For comparison purposes, soft magnetic powders were prepared by flattening particles of Sendust alloy, Permalloy, Molybdenum Permalloy and Fe base amorphous alloy under the same conditions as in Example 3. They were examined and evaluated by the same tests as above. The results are also shown in Table 3.

More particularly, sample Nos. 201–203 within the scope of the invention show a shorter flattening time and a negative value of saturation magnetostriction constant λs. They also satisfy the low coercive force requirement as magnetic shields, provide high shielding ratios when formed into magnetic shield plates, and maintain such shielding property unchanged upon stress application.

Sample Nos. 204–207 having a composition outside line JN or LM in FIG. 4 require a longer time to flatten and show poor magnetic shield properties.

Sample Nos. 205 and 207 having a composition outside line JK or KL in FIG. 4 and sample No. 209 (Sendust alloy) experience a substantial loss of magnetic shield properties upon stress application.

Sample Nos. 204 and 206 having a composition outside line MN is rather increased in magnetic shield properties upon stress application, but generally poor in all the aspects.

Sample Nos. 210 to 212 corresponding to Permalloy and Fe base amorphous alloy are poor in productivity since they require at least two or three times longer time to flatten than the present samples. Their shielding properties are poor and deteriorated upon stress application.

EXAMPLE 5

An alloy having the composition 85.1 wt % Fe-10.1 wt % Si-4.8 wt % Al within the scope of the invention was measured for various properties while the heat treating conditions were varied. The test conditions are the same as in Example 4.

The results are shown in Table 4.

Figure 5:
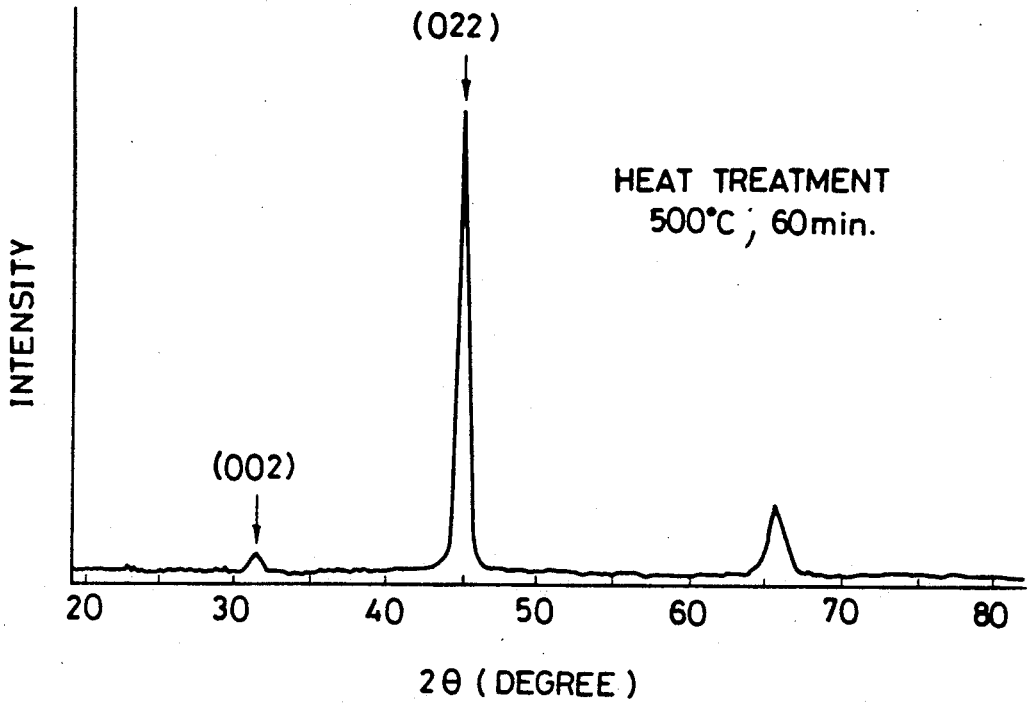
FIG. 5 is an X-ray diffraction diagram of flat soft magnetic particles of Fe-Si-Al system which have been heat treated at 500° C. for 60 minutes (sample No. 225).
Figure 6:
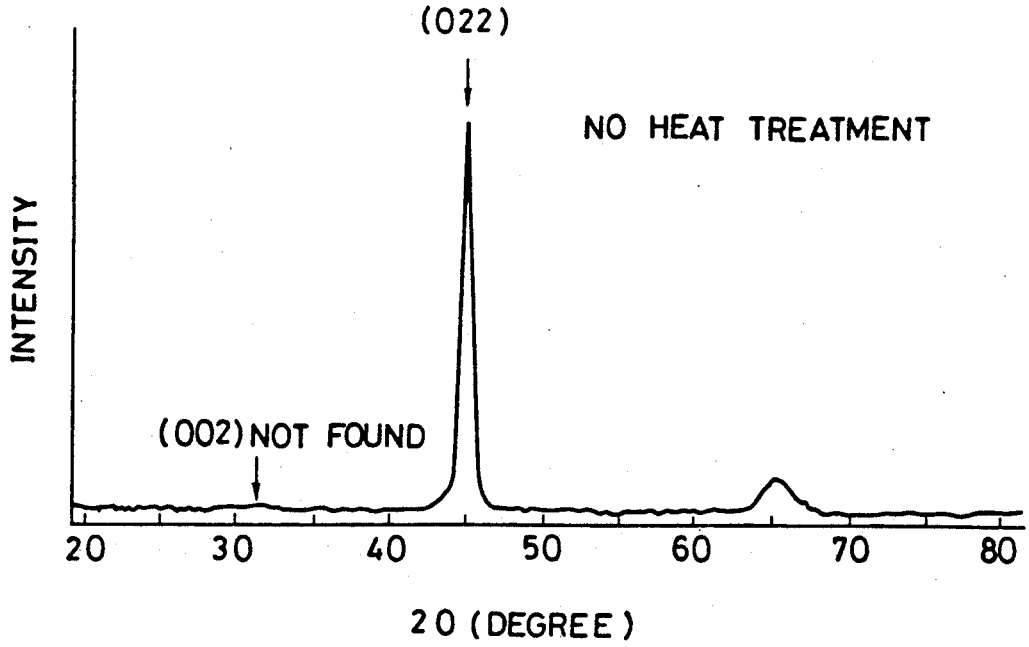
FIG. 6 is an X-ray diffraction diagram of the same flat soft magnetic particles prior to heat treatment (sample No. 221).

Sample Nos. 225 and 221 were analyzed by X-ray diffraction using a Cu target. X-ray diffraction diagrams are shown in FIGS. 5 and 6.

TABLE 4

| Sample No. | Heat treatment °C./min. | P(002)/P(022) % | Hc Oe | Shielding ratio | Remarks |
|---|---|---|---|---|---|
| 221 | no | (002) none | 17 | 200 | |
| 222 | 200/60 | 1.0 | 4 | 105 | |
| 223 | 300/60 | 1.7 | 5 | 101 | |
| 224 | 400/60 | 3.6 | 8 | 95 | |
| 225 | 500/60 | 4.6 | 9 | 100 | |
| 226 | 700/60 | unmeasurable | — | — | ignited |

TABLE 3

| Sample No. | Composition Fe | Si | Al | Heat Treatment (°C./min.) | P(002)/P(022) (%) | λs ($10^{-6}$) | Flattening Time (hour) | Hc (Oe) | Shield ratio** | Change under stress (%) | Remarks |
|---|---|---|---|---|---|---|---|---|---|---|---|
| 201 | 84.0 | 9.5 | 6.5 (wt %) | 450 × 60 | 3.5 | −1.0 | 4.5 | 5.0 | 100 | −2 | |
| 202 | 84.7 | 9.8 | 5.5 (wt %) | 450 × 60 | 4.5 | −0.7 | 4.5 | 4.0 | 100 | 0 | |
| 203 | 85.3 | 10.2 | 4.5 (wt %) | 450 × 60 | 3.5 | −0.3 | 4.8 | 5.0 | 107 | −5 | |
| 204* | 82.8 | 10.0 | 7.2 (wt %) | 450 × 60 | 2.0 | −0.4 | 8.0 | 8.0 | 165 | −10 | |
| 205* | 86.4 | 10.2 | 3.4 (wt %) | 450 × 60 | 1.5 | 1.0 | 7.0 | 9.0 | 170 | 80 | |
| 206* | 85.0 | 11.6 | 3.4 (wt %) | 450 × 60 | 2.0 | −3.0 | 7.0 | 8.0 | 165 | −8 | |
| 207* | 83.8 | 9.0 | 7.2 (wt %) | 450 × 60 | 1.8 | 0.5 | 7.0 | 10.0 | 190 | 60 | |
| 208* | 85.0 | 9.6 | 5.4 (wt %) | NO | NONE | 0.1 | 5.0 | 15.0 | 185 | 20 | Sendust alloy |
| 209* | 85.0 | 9.6 | 5.4 (wt %) | 450 × 60 | 5.6 | 0.1 | 5.0 | 12.0 | 150 | 30 | Sendust alloy |
| 210* | $Fe_{50}Ni_{50}$ (wt %) | | | NO | NONE | 20.0 | 16.0 | 20.0 | 250 | 350 | Permalloy |
| 211* | $Ni_{80}Mo_5Fe_{15}$ (wt %) | | | NO | NONE | 0.0 | 16.0 | 15.0 | 180 | 35 | Permalloy |
| 212* | $Fe_{69}Cr_4Nb_3Si_{18}B_6$ (at %) | | | 450 × 60 | NONE | 15.0 | 12.0 | 4.0 | 120 | 230 | Amorphous alloy |

*comparison
**relative value based on No. 201 = 100

The effectiveness of the invention is evident from Table 3.

EXAMPLE 6

Alloy particles of the compositions shown in Table 3 were heat treated at 450° C. for one hour before flattening under the same conditions as in Example 4. The time taken for flattening was reduced by 10% or more.

The effectiveness of the invention is evident from the examples.

The flat soft magnetic particles of which the soft magnetic powder of the invention is comprised are quite suitable for producing magnetic shields since they have high magnetic permeability, a low coercive force, a saturation magnetostriction constant λs which can be 0 or negative, and high corrosion resistance.

Since the starting material is alloy particles susceptible to cleavage, flat soft magnetic particles having a high aspect ratio can be produced briefly. Since flattening is followed by heat treatment to create the desired crystal structure, there are obtained particles having satisfactory magnetic properties.

The magnetic shield composition using such soft magnetic powder is inexpensive, effective in performance and thus applicable as magnetic shields for use in various electrical equipment such as speakers and cathode ray tubes (CRT).

Although some preferred embodiments have been described, many modifications and variations may be made thereto in the light of the above teachings. It is therefore to be understood that within the scope of the appended claims, the invention may be practiced otherwise than as specifically described.

We claim:

1. A soft magnetic powder for use in magnetic shield comprising flat soft magnetic particles of an alloy having a composition defined and encompassed by polygon ABCDE in a ternary composition diagram of Fe, Si, and Cr wherein points A, B, C, D, and E have the following compositions as expressed in atomic percentage A: $Fe_{78}Si_{22}Cr_0$
B: $Fe_{70}Si_{30}Cr_0$
C: $Fe_{60}Si_{30}Cr_{10}$
D: $Fe_{63}Si_{18}Cr_{19}$
E: $Fe_{76}Si_{18}Cr_6$ wherein said flat soft magnetic particles have a weight average particle diameter $D_{50}$ of 5 to 30 μm and an average thickness of up to 1 μm, the average particle diameter divided by the average thickness being from 10 to 3,000.

2. The soft magnetic powder of claim 1 wherein the flat soft magnetic particles show a peak corresponding to plane index (002) in an X-ray diffraction diagram thereof.

3. The soft magnetic powder of claim 2 wherein the flat soft magnetic particles meet $P(002)/P(022) \geqq 0.1\%$ wherein P(002) is a peak height corresponding to plane index (002) and P(022) is a peak height corresponding to plane index (022) in the X-ray diffraction diagram.

4. The soft magnetic powder of claim 2 wherein said alloy has a negative saturation magnetostriction constant λs.

5. A magnetic shield composition comprising a soft magnetic powder as set forth in any one of claim 1 to 4 and a binder.

6. A soft magnetic powder for use in magnetic shields comprising flat soft magnetic particles of an ally having a composition defined and encompassed by polygon JKLMN in a ternary composition diagram of Fe, Si, and Al wherein points J, K, L, M, and N have the following compositions as expressed in atomic percentage:

J: $Fe_{83.8}Si_{9.2}Al_7$
K: $Fe_{84.7}Si_{9.3}Al_6$
L: $Fe_{85.6}Si_{10.4}Al_{4.0}$
M: $Fe_{84.9}Si_{11.1}Al_{4.0}$
N: $Fe_{83.2}Si_{9.8}Al_7$ wherein the flat soft magnetic particles show a peak corresponding to plane index (002) in an X-ray diffraction diagram thereof and wherein said flat soft magnetic particles have a weight average particle diameter $D_{50}$ of 5 to 30 μm and an average thickness of up to 1 μm.

7. The soft magnetic powder of claim 6 wherein the flat soft magnetic particles meet $P(002)/P(022) \geqq 0.1\%$ wherein P(002) is a peak height corresponding to plane index (002) and P(022) is a peak height corresponding to plane index (022) in the X-ray diffraction diagram.

8. The soft magnetic powder of claim 6 wherein said alloy has a saturation magnetostriction constant λs of at most zero.

9. The soft magnetic powder of claim 6 wherein said flat soft magnetic particles have an average particle diameter and an average thickness, the average particle diameter divided by the average thickness being from 10 to 3,000.

10. A magnetic shield composition comprising a soft magnetic powder as set forth in any one of claim 6 to 9 and a binder.

11. A soft magnetic powder for use in magnetic shields comprising flat soft magnetic particles of an alloy having a composition defined and encompassed by polygon FGHIE in a ternary composition diagram of Fe, Si, and Cr wherein points F, G, H, I, and E have the following composition as expressed in atomic percentage F: $Fe_{77}Si_{20}Cr_3$
G: $Fe_{71}Si_{26}Cr_3$
H: $Fe_{62}Si_{26}Cr_{12}$
I: $Fe_{70}Si_{18}Cr_{12}$
E: $Fe_{76}Si_{18}Cr_6$ wherein said flat soft magnetic particles have a weight average particle diameter $D_{50}$ of 5 to 30 μm and an average thickness of up to 1 μm, the average particle diameter divided by the average thickness being from 10 to 3,000.

12. A soft magnetic powder for use in magnetic shields comprising flat soft magnetic particles of an alloy having a composition defined and encompassed by polygon JKLQR in a ternary composition diagram of Fe, Si, and Al wherein points j, K, L, Q, and R have the following compositions as expressed in atomic percentage:

J: $Fe_{83.8}Si_{9.2}Al_7$
K: $Fe_{84.7}Si_{9.3}Al_6$
L: $Fe_{85.6}Si_{10.4}Al_{4.0}$
Q: $Fe_{85.1}Si_{10.9}Al_{4.0}$
R: $Fe_{83.5}Si_{9.5}Al_{7.0}$ wherein the flat soft magnetic particles show a peak corresponding to plane index (002) in an X-ray diffraction diagram thereof and wherein said flat soft magnetic particles have a weight average particle diameter $D_{50}$ of 5 to 30 μm and an average thickness of up to 1 μm.

* * * * *

UNITED STATES PATENT AND TRADEMARK OFFICE

CERTIFICATE OF CORRECTION

PATENT NO. : 5,207,841

DATED : May 4, 1993

INVENTOR(S) : Masao Shigeta ,et al

It is certified that error appears in the above-indentified patent and that said Letters Patent is hereby corrected as shown below:

Column 15, line 66, "ally" should read --alloy--

Column 16, line 36, "composition" should read --compositions--;
line 52, "j" should read --J--

Signed and Sealed this

Twenty-seventh Day of September, 1994

*Attest:*

Bruce Lehman

BRUCE LEHMAN

*Attesting Officer*

*Commissioner of Patents and Trademarks*